US006027101A

United States Patent [19]

Marx

[11] Patent Number: 6,027,101

[45] Date of Patent: Feb. 22, 2000

[54] BOTTLE JACK AND METHOD

[76] Inventor: Rodger L. Marx, 23692 Newton Fork Rd., Hill City, S. Dak. 57745

[21] Appl. No.: 09/039,934

[22] Filed: Mar. 16, 1998

[51] Int. Cl.[7] ..... B66F 3/24

[52] U.S. Cl. ..... 254/93 H

[58] Field of Search ..... 417/470, 471, 417/374; 254/93 H, 93 R, 2 B, 2 R

[56] References Cited

U.S. PATENT DOCUMENTS

| | | | |
|---|---|---|---|
| 1,964,003 | 6/1934 | McBride | 254/93 H |
| 1,990,004 | 2/1935 | Shannon | 254/93 H |
| 2,002,318 | 5/1935 | Heuber et al. | 417/470 |
| 2,471,770 | 5/1949 | Noble | 254/93 H |
| 3,615,157 | 10/1971 | D'Amico Trotta . | |
| 3,786,692 | 1/1974 | Bjork . | |
| 3,885,449 | 5/1975 | Green . | |
| 4,497,501 | 2/1985 | Kedem . | |
| 4,589,669 | 5/1986 | Kedem . | |
| 4,641,815 | 2/1987 | Yu . | |
| 4,656,879 | 4/1987 | Jen | 254/93 H |
| 4,703,916 | 11/1987 | Hung | 254/93 H |
| 4,850,568 | 7/1989 | Hung . | |
| 4,895,042 | 1/1990 | Wang . | |
| 5,431,369 | 7/1995 | Hung . | |
| 5,551,668 | 9/1996 | Hung | 254/93 H |

*Primary Examiner*—Robert C. Watson

*Attorney, Agent, or Firm*—Meroni & Meroni; Charles F. Meroni, Jr.

[57] ABSTRACT

This invention concerns an improved bottle jack. The invention comprises in combination, an improved bottle jack having a handle, fluid, and pump means and the improved bottle jack comprising the following. A base with the pump means being operatively connected to the base. An anchor rod having a lower anchor rod end and an upper anchor rod end being located opposite the lower anchor rod end, the anchor rod being located proximate the pump means and being pivotably connected to the base at the lower anchor rod end, the handle being pivotably connected to the anchor rod at the upper anchor rod end. A spring collar yoke being removably and pivotably connected to the handle and to the pump means, the spring collar yoke being located proximate the upper anchor rod end, the spring collar yoke being capable of concentrically enclosing the pump means. Finally, a compression spring being removably and operatively connected to the base at the lower spring end, the compression spring being removably and operatively connected to the spring collar yoke at the upper spring end to align the compression spring, the compression spring concentrically enclosing the pump means, the compression spring being capable of vertical translation as the handle is vertically translated between an upper position and a lower position as loads on the handle are transferred to the pump means and as the pump means reciprocates and as the compression spring returns the handle to the upper position.

18 Claims, 9 Drawing Sheets

BOTTLE JACK AND METHOD

BACKGROUND OF THE INVENTION

1. Field of the Invention

The present invention relates to hydraulic jacks and the addition of a spring return mechanism. More specifically, the invention is primarily intended for use on bottle jacks wherein the spring return mechanism automatically returns a handle to an upper position to await the next pumping stroke and wherein a pump rod and pump cylinder assembly of the bottle jack is automatically recharged with fluid.

2. Description of the Prior Art

In the art of hydraulic jacks a bottle jack is a type of jack that is shaped like a bottle and has an external fluid level that encompasses a hydraulic piston or ram centrally located to the bottle itself that is in turn raised by means of a lever or handle that is pushed down upon a small pump connected to the hydraulic piston to discharge fluid to the hydraulic piston or ram. The pump forces the fluid from a fluid reservoir in the small pump into the pump chamber which itself houses a pump rod attached to the handle.

The state of the art is such that the handle is used to depress down the pump rod to discharge the fluid to the hydraulic piston and then handle is pulled back up, i.e. manually, to recharge the pump chamber for the next stroke and depression of the handle. In other words, the stroking of the pump rod is performed manually. U.S. Pat. No. 4,641,815 is an example showing a Hydraulic Jack that requires this manual stroking of the pump rod.

Various devices have also been created in order to overcome the manual nature of stroking the pump rod. U.S. Pat. No. 4,895,042 shows a Pump Lever For A Jack comprising a protrusion near a plunger of a fluid pump and the attachment of a torsion spring 50 which torsion spring is then used to urge the handle to its uppermost position when the handle is freed. This patent shows the use of the torsion spring on a hydraulic service jack such as a standard or high-lift jacks.

In addition, U.S. Pat. No. 5,551,668 shows a Hydraulic Jack With Restorable Lever And Retaining Device disclosing the use of a compression spring 6 on a hydraulic service jack, such as a standard or high-lift jack. The compression spring is placed in a positioning blind hole 25 which is offset a distance from the pump assembly and piston. This location of a compression spring does not form an integral part of the jack and also does not have a collar or yoke to provide alignment to the compression spring to thereby prevent it from bending or buckling during compression. Bending and buckling directs the load away from a plane of movement of the handle and therefore decreases the efficiency of the spring.

Furthermore, U.S. Pat. No. 3,885,449 discloses a Foot Operation For A Pump discloses a helical spring 38 supported by a rod 30 which also is placed so as to offset the piston rod of a pump by a distance. This spring is not placed directly over the piston rod. Finally, U.S. Pat. No. 4,589,669 discloses a Pallet Truck With Hydraulic Lift that utilizes an elongated coil compression spring 101, that while surrounding the pump cylinder 91, does not urge the handle 113 upward and does not utilize a three pinned anchor rod system employed in bottle jacks or hydraulic hand jacks and the like.

What is needed then is a means for automatically returning a handle of a bottle jack, or hydraulic hand jack, to its uppermost position to await a subsequent stroke of the handle and pump rod. Such a device would then allow the user to utilize the bottle jack using a hand or foot without needing to manually pulling the handle upwards after each downward stroke. Furthermore, such a device would act to automatically recharge the pump chamber with fluid, such as hydraulic fluid, after each downward stroke.

Accordingly, it is a principal object of my invention to provide an improved bottle jack that overcomes all of the disadvantages of the lever structures of the prior art.

It is a further object of my invention to provide an improved bottle jack that automatically returns the handle to its uppermost position following the downward depression, or stroke, of the handle and the pump rod to the handle's lowermost position and the manual release of the handle at the lowermost position.

It is a still further object of my invention to provide an improved bottle jack that automatically recharges the pump chamber with the fluid after the handle is manually released following the downward depression, or stroke, of the handle.

It is a further object of my invention to provide an improved bottle jack that is economical, easy to use, and easy to construct, which can be tailored to and retrofitted to an existing bottle jack.

Other objects of my invention, as well as particular features, elements, and advantages thereof, will be elucidated in, or apparent from, the following description and the accompanying drawing figures.

SUMMARY OF THE INVENTION

According to my present invention I have provided in combination, an improved bottle jack having a handle, fluid, and a pump rod and pump cylinder assembly. The pump rod and pump cylinder assembly has a pump longitudinal axis. The improved bottle jack comprises: a base with the pump rod and pump cylinder assembly being fixably connected to the base. An anchor rod is located proximate the pump rod and pump cylinder assembly and is parallel the pump longitudinal axis. The anchor rod has a lower anchor rod end and an upper anchor rod end that is located opposite the lower anchor rod end with the anchor rod being pivotably connected to the base at the lower anchor rod end by a lower anchor rod pin. The lower anchor rod pin is positioned at a fixed lower distance from the pump rod and pump cylinder assembly. The lower anchor rod pin has a lower anchor rod pin axis that is fixably located and positioned perpendicular relative to the pump longitudinal axis and the anchor rod is thereby capable of rotation about the lower anchor rod pin axis in a plane parallel the pump longitudinal axis.

The handle is pivotably connected to the anchor rod at the upper anchor rod end by an upper anchor rod pin which is positioned at a variable upper distance from the pump rod and pump cylinder assembly. The upper anchor rod pin has an upper anchor rod pin axis that is variably located and positioned perpendicular relative to the pump longitudinal axis. The handle is capable of rotation about the upper anchor rod pin axis in the plane parallel the pump longitudinal axis.

A spring collar yoke is removably and pivotably connected to the handle and to the pump rod and pump cylinder assembly by a pump rod pin. The spring collar yoke is capable of concentrically enclosing the pump rod and pump cylinder assembly. The pump rod pin has a pump rod pin axis that is fixably located and positioned perpendicular relative to the pump longitudinal axis. The pump rod pin is located a fixed distance from the upper anchor rod pin while the upper anchor rod pin is located a fixed distance from the lower anchor rod pin. The spring collar yoke and the pump rod pin axis are capable of vertical translation about the pump rod and pump cylinder assembly when the handle is vertically translated and rotated between an upper position and a lower position. The handle and the spring collar yoke are each capable of rotation about the pump rod pin axis in the plane parallel the pump longitudinal axis. The spring collar yoke is located proximate the upper anchor rod end and the upper anchor rod pin. The pump rod pin, the lower anchor rod pin, and the upper anchor rod pin each form a corner of a variable triangle which variable triangle is located in the plane parallel the pump longitudinal axis and is capable of changing back and forth between an oblique angled triangular shape and an acute angled triangular shape as the handle is vertically translated and rotated between the upper position and the lower position respectively.

Finally, a compression spring having a lower spring end and an upper spring end that is located opposite the lower spring end, is removably and operatively connected to the base at the lower spring end. The compression spring is removably and operatively connected to the spring collar yoke at the upper spring end to align the compression spring. The compression spring concentrically encloses the pump rod and pump cylinder assembly and is positioned parallel the pump longitudinal axis. The compression spring is capable of vertical translation in the plane parallel the pump longitudinal axis as the handle is vertically translated and rotated between the upper position and the lower position and as the pump rod and pump cylinder reciprocates to thereby change the variable triangle back and forth between the oblique angled triangular shape and the acute angled triangular shape respectively as loads on the handle are transferred to the pump rod and pump cylinder assembly and as the compression spring returns the handle to the upper position. The compression spring urges the handle and the spring collar yoke upwards thereby creating a negative pressure within the pump rod and pump cylinder assembly and thereby drawing the fluid into the pump rod and pump cylinder assembly as the handle returns to the upper position. The compression spring and the spring yoke collar thereby forms an integral part of the improved bottle jack to automatically return the handle to the upper position from the lower position thereby creating the oblique angled triangular shape and to automatically recharge the pump rod and pump cylinder assembly with the fluid. Yet another feature of my invention relates to a method of retrofitting a bottle jack to create an improved bottle jack. The method comprises the steps of: (a) removing a rod pin from a handle and pump means; (b) detaching the handle from the pump means thereby exposing the pump means; (c) concentrically placing a compression spring over the exposed pump means thereby circumferentially enclosing the pump means; (d) placing a spring collar yoke over the placed compression spring and circumferentially enclosed pump means; (e) replacing the handle on the circumferentially enclosed pump means; and (f) placing a pump rod pin on the replaced handle and circumferentially enclosed pump means thereby connecting the spring collar yoke and the compression spring to the replaced handle and circumferentially enclosed pump means to automatically return the replaced handle to an upper position and to automatically recharge the circumferentially enclosed pump means with a fluid.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
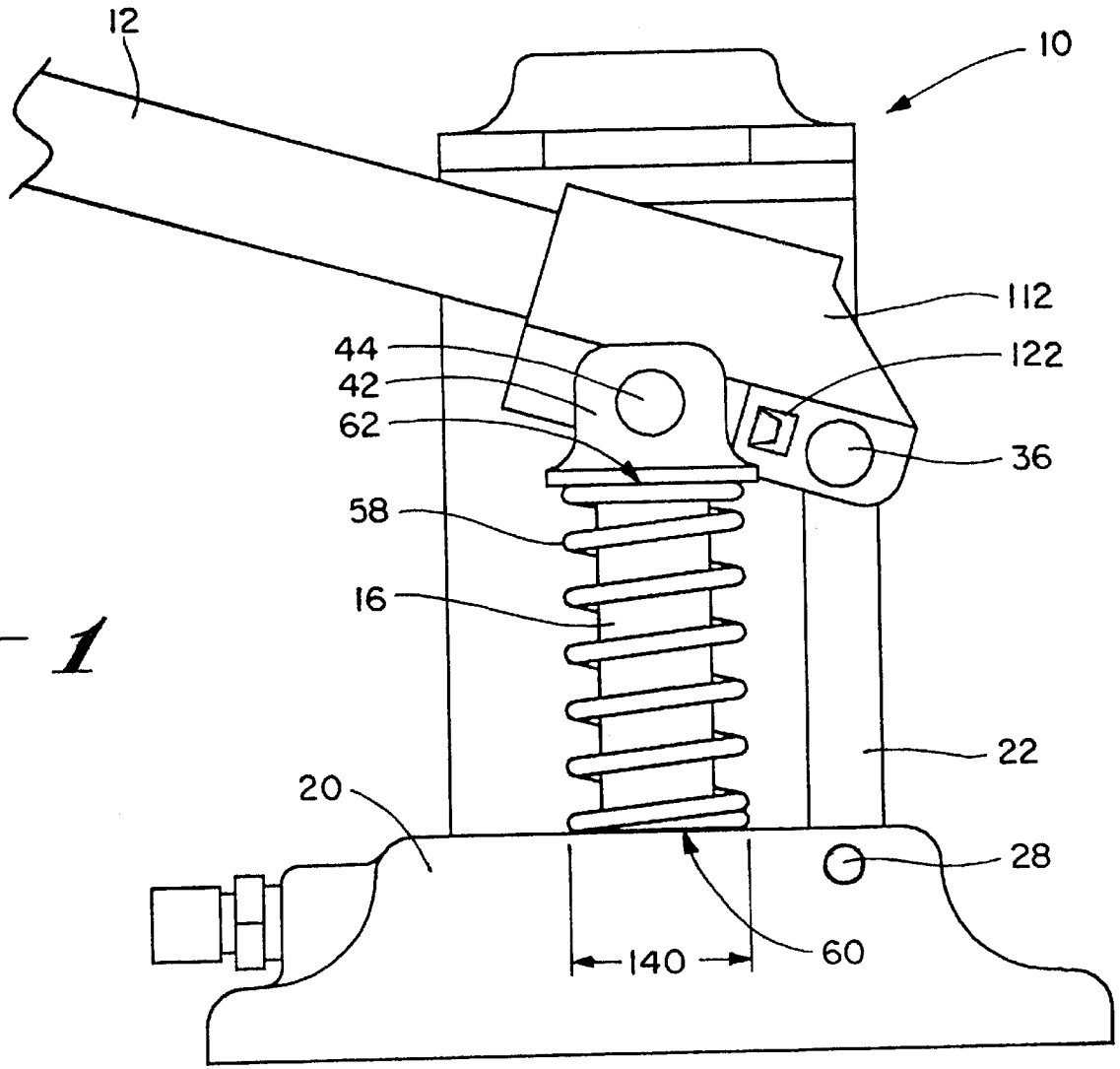
FIG. 1 is a side view of my improved bottle jack showing the attachment of a spring collar yoke and a compression spring to the bottle jack.

Referring now to the drawings, my invention provides in combination, an improved bottle jack 10 for overcoming the problems of the prior art by allowing the user to utilize the bottle jack using a hand or a foot without needing to manually pulling a handle 12 upwards after each downward stroke. My invention also automatically recharges a pump chamber 130 with fluid 14, such as hydraulic fluid, after each downward stroke shown as arrow A in FIGS. 4, 7–9, and it provides a means for retrofitting an existing bottle jack in order to incorporate the advantages of my invention.

Figure 2:
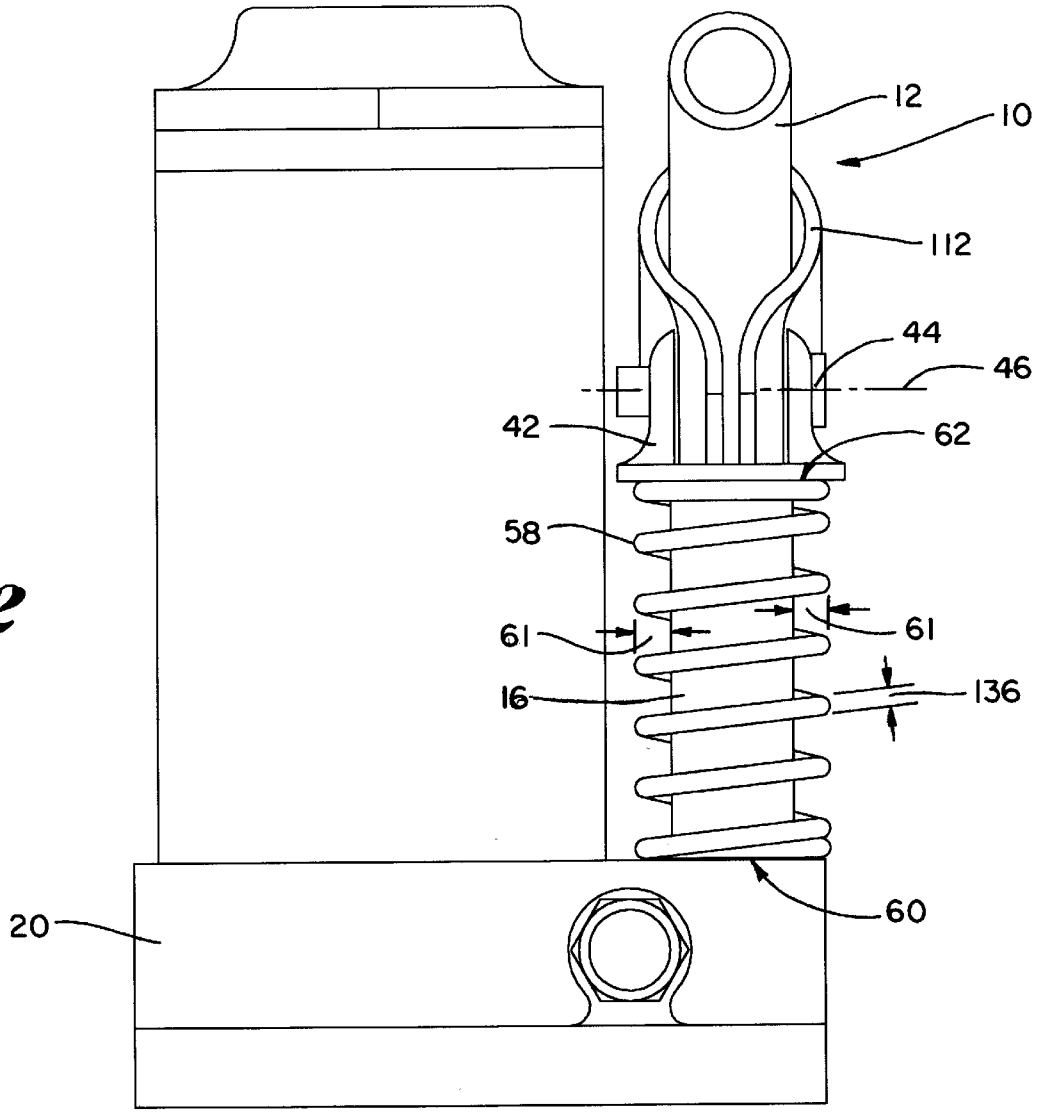
FIG. 2 is a front view of the improved bottle jack of FIG. 1 showing the attachment of the spring collar yoke to a handle bracket and a pump rod and pump cylinder assembly, the compression spring being operatively connected to the spring collar yoke.
Figure 3:
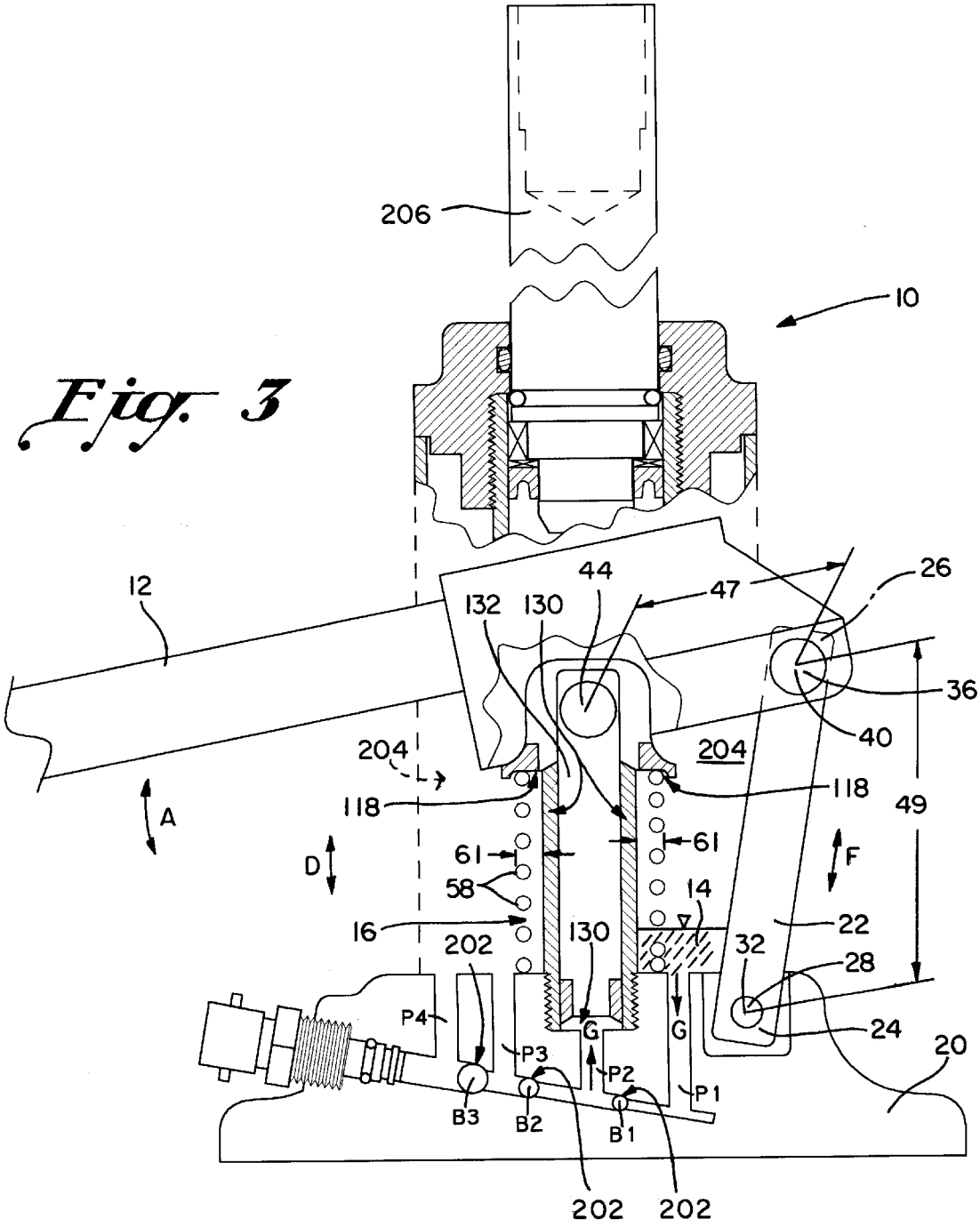
FIG. 3 is a side sectional view of the improved bottle jack in FIG. 1 showing the pump chamber of the pump rod and pump cylinder assembly and the various passageways and various check balls, the compression spring shown in a compressed state as a handle approaches a lower position.
Figure 4:
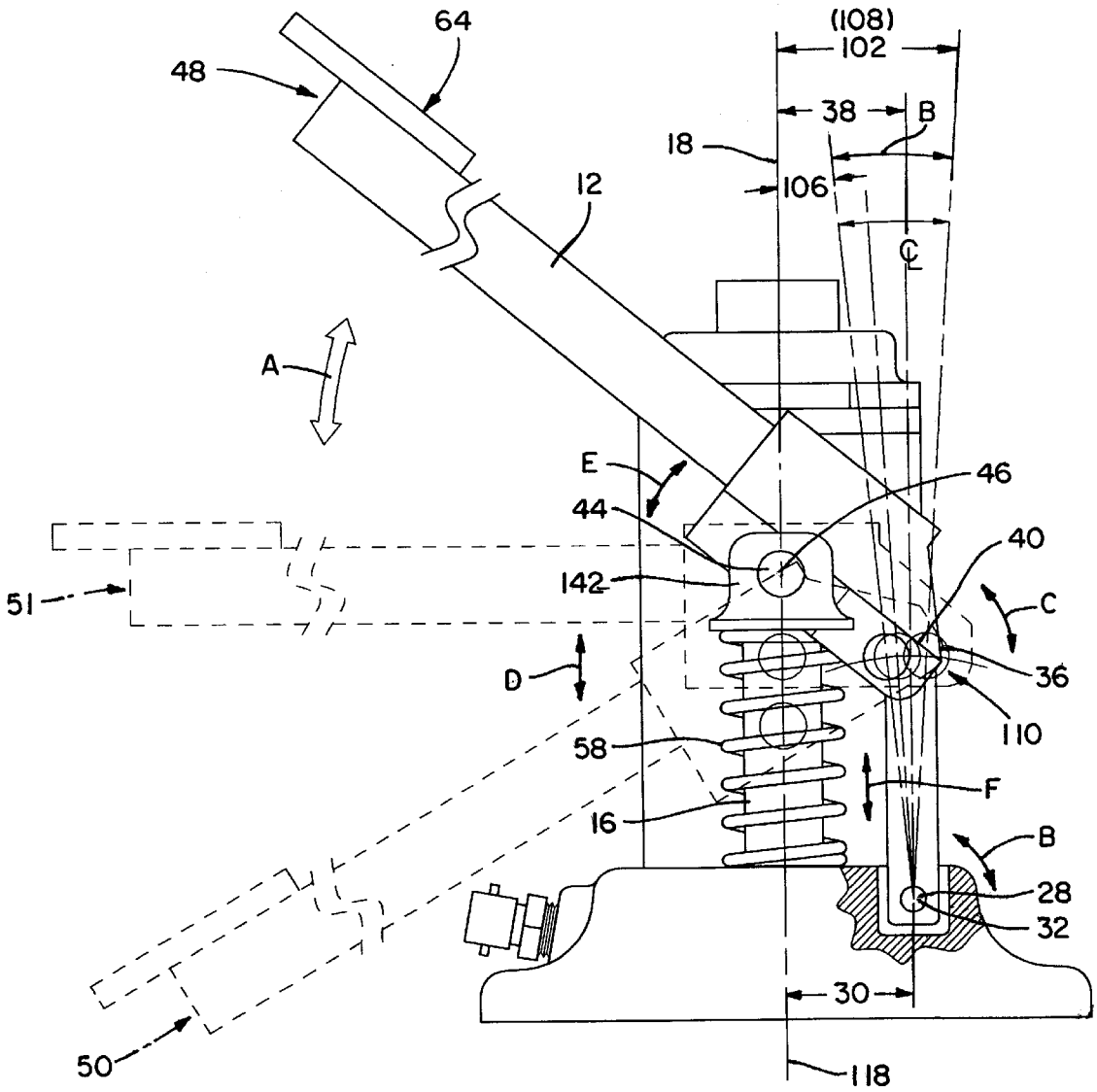
FIG. 4 is side view of the improved bottle jack showing the vertical translation of the handle from the upper position to the lower position and the corresponding rotation of an anchor rod about an upper anchor rod pin and a lower anchor rod pin.

FIGS. 1–3 show the improved bottle jack 10 having the handle 12, fluid 14, and a pump rod and pump cylinder assembly 16. The pump rod and pump cylinder assembly has a pump longitudinal axis 18 running through a center line of the pump rod and cylinder assembly as shown in FIG. 4. In other embodiments, the pump rod and pump cylinder assembly 16 is a pump means.

As shown in FIG. 1, the improved bottle jack 10 comprises: a base 20, an anchor rod 22, a spring collar yoke 42, and a compression spring 58. The pump rod and pump cylinder assembly 16 is fixably connected to the base 20 by means such as by thread and screw and the like, as shown in FIGS. 3, 5, and 6.

Figure 5:
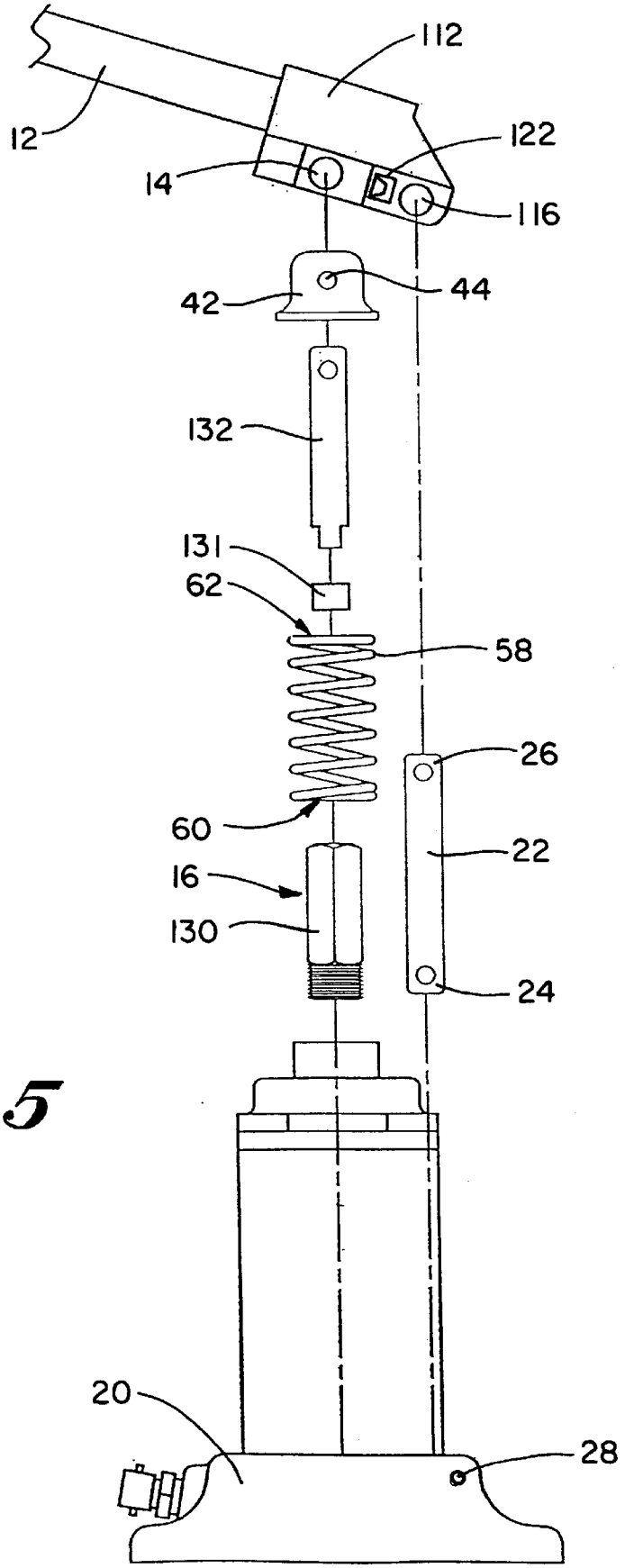
FIG. 5 is side fragmented view of the improved bottle jack of FIG. 1 showing the placement of the compression spring and the spring collar yoke over the pump rod and pump cylinder assembly and the connection of the handle to the spring collar yoke and the anchor rod.
Figure 6:
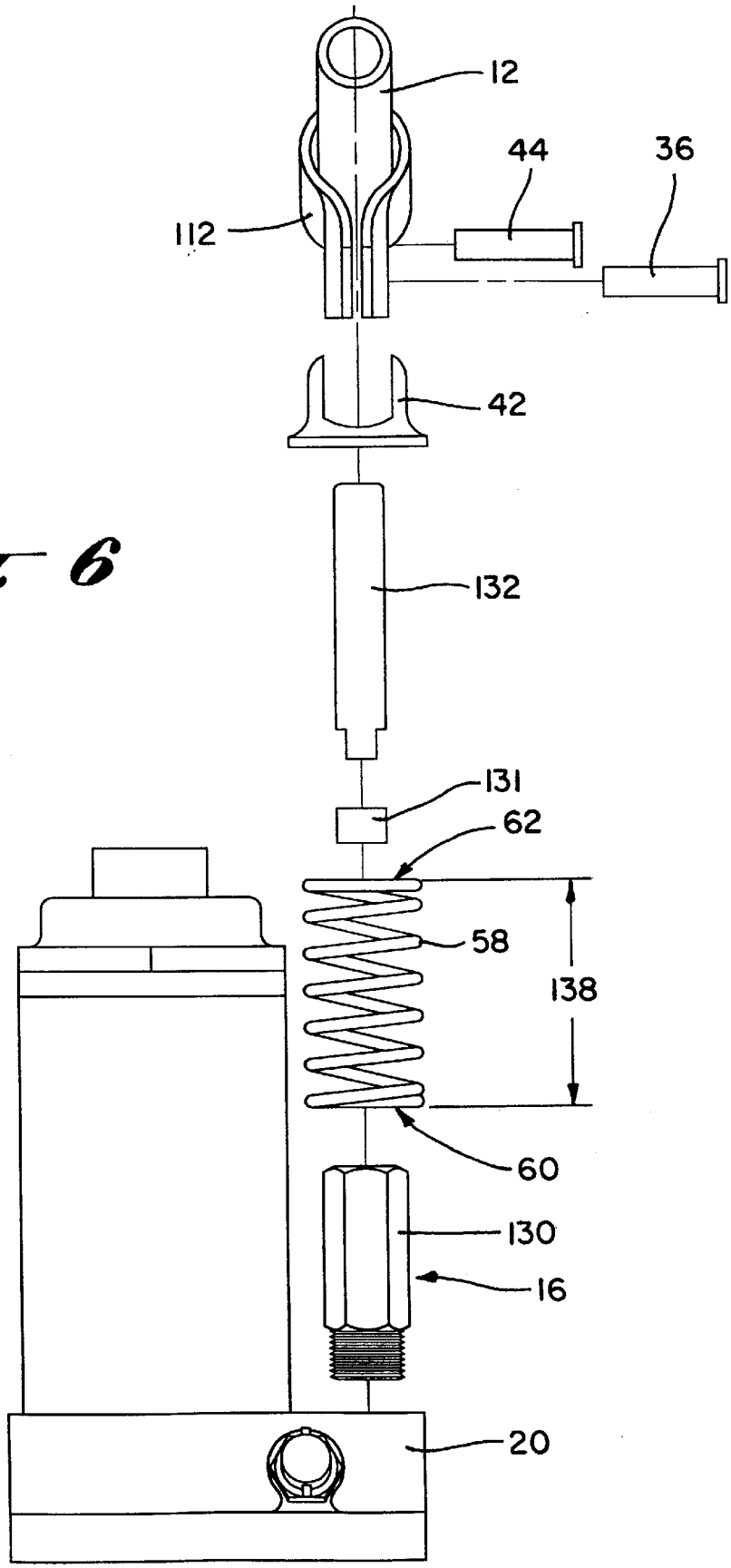
FIG. 6 is a front fragmentary view of the improved bottle jack of FIG. 2 showing the connection of the handle bracket and the handle to the spring collar yoke, the pump rod and pump cylinder assembly, and the compression spring by means of a pump rod pin and the upper anchor rod pin.

The anchor rod 22, as shown in FIGS. 1, 3–5, is located proximate the pump rod and pump cylinder assembly 16 and is positioned parallel the pump longitudinal axis 18, or approximately parallel, depending upon the position of the handle 12 as will be further explained below. The anchor rod 22 has a lower anchor rod end 24 and an upper anchor rod end 26 that is located opposite the lower anchor rod end, as shown in FIGS. 3 and 5, and the anchor rod is pivotably connected to the base 20 at the lower anchor rod end by a lower anchor rod pin 28, shown in FIGS. 1, 3–4. In other embodiments, the anchor rod 22 is an anchor means.

The lower anchor rod pin 28 is positioned, as shown in FIG. 4, at a fixed lower distance 30 from the pump rod and pump cylinder assembly 16, and in the preferred embodiment the fixed lower distance measures 1.1 inches. The lower anchor rod pin 28 has a lower anchor rod pin axis 32, shown in FIG. 4 as into the plane of the paper through the lower anchor rod pin axis, and the lower anchor rod pin is fixably located and positioned perpendicular relative to the pump longitudinal axis 18. The anchor rod 22 is thereby capable of rotation, as shown by an arrow B in FIG. 4, about the lower anchor rod pin axis 32 in a plane 34 (not shown) running parallel the pump longitudinal axis 18, or in other words, the plane of the paper as viewed.

The handle 12 is pivotably connected to the anchor rod 22 at the upper anchor rod end 26 by an upper anchor rod pin 36 shown in FIGS. 1, 3, 4, and 6. The upper anchor rod pin 36 is positioned at a variable upper distance 38 from the pump rod and pump cylinder assembly 16 as shown in FIGS. 4, 7–9 and as explained below. The upper anchor rod pin 36 has an upper anchor rod pin axis 40, as shown in FIG. 4 into the plane of the paper, and the upper anchor rod pin is variably located and positioned perpendicular relative to the pump longitudinal axis 18. The handle 12 is capable of rotation, shown by arrow C in FIG. 4, about the upper anchor rod pin axis 40 in the plane 34, i.e. the plane of the paper, parallel the pump longitudinal axis 18.

As a key feature of my invention, the spring collar yoke 42 is removably and pivotably connected to the handle 12 and to the pump rod and pump cylinder assembly 16 by a pump rod pin 44, as is shown in FIGS. 1–2, and 6 and as explained below. The spring collar yoke 42 is capable of concentrically enclosing the pump rod and pump cylinder assembly 16, as shown in FIGS. 2, 5, and 6. The pump rod pin 44 has a pump rod pin axis 46 that is fixably located and positioned perpendicular relative to the pump longitudinal axis 18, as shown in FIGS. 2 and 4 and the pump rod pin is located a fixed distance 47 from the upper anchor rod pin 36 as shown in FIG. 3 and that fixed distance is 1.2 inches in the preferred embodiment. The upper anchor rod pin 36 is located a fixed distance 49 from the lower anchor rod pin 28 as shown in FIG. 3 and measures 2.95 inches in the preferred embodiment.

The spring collar yoke 42 and the pump rod pin axis 46 are capable of vertical translation, shown by an arrow D in FIG. 4, about the pump rod and pump cylinder assembly 16 when the handle 12 is vertically translated and rotated, arrow A, between an upper position 48 and a lower position 50 while passing through an intermediate position 51. The handle 12 and the spring collar yoke 42 each are capable of rotation, as shown by an arrows D and E in FIG. 4, about the pump rod pin axis 46 in the plane 34 parallel the pump longitudinal axis 18. The spring collar yoke 42 is located proximate the upper anchor rod end 26 and the upper anchor rod pin 36.

Figure 7:
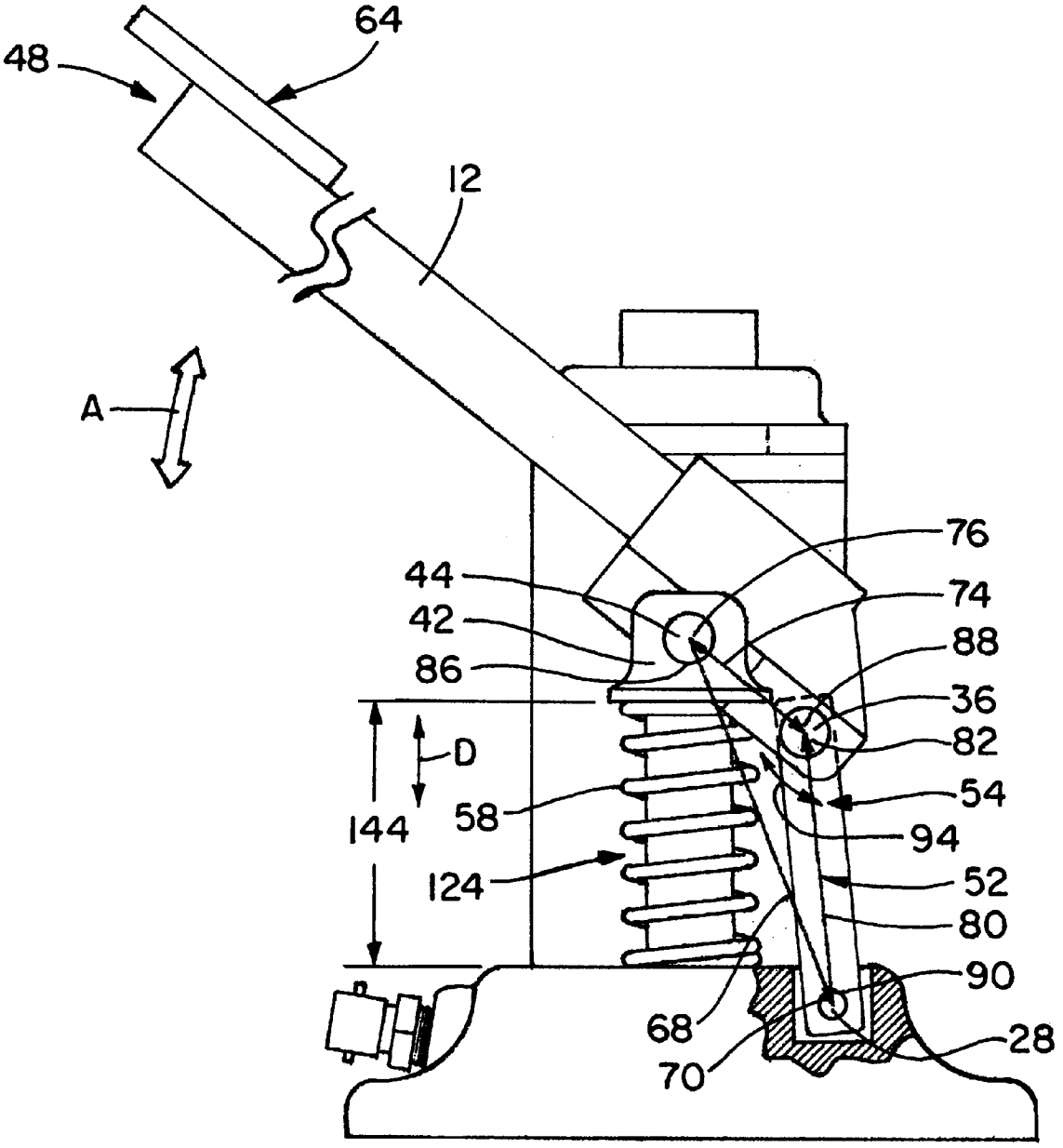
FIG. 7 is a side view of the improved bottle jack of FIG. 4 with the handle being located in the upper position and showing a variable triangle having an oblique angled triangular shape.

The geometry of the pinned relationship and the operation of my invention can be described as follows and as viewed in FIGS. 4, 7–9. The pump rod pin 44, the lower anchor rod pin 28 and the upper anchor rod pin 36 each form a corner of a variable triangle 52 as shown in its various stages in FIGS. 7–9. The variable triangle 52 is located in the plane 34, i.e. the plane of the paper, parallel the pump longitudinal axis 18 and is capable of changing back and forth between an oblique angled triangular shape 54, as shown in FIG. 7 and an acute angled triangular shape 56, as shown in FIG. 9, as the handle 12 is vertically translated and rotated, arrow A in FIGS. 4, 7–9, between the upper position 48, shown in FIG. 7, and the lower position 50, shown in FIG. 9, as shown respectively.

The other key feature of my invention, the compression spring 58, has a lower spring end 60 and an upper spring end 62 that is located opposite the lower spring end, as shown in FIGS. 1–2, 5–6. As shown, the compression spring 58 is removably and operatively connected to the base 20 at the lower spring end 60 and the compression spring 58 is removably and operatively connected to the spring collar yoke 42 at the upper spring end 62 in order to align 61 the compression spring, as shown in FIG. 3. This ability to remove the compression spring allows the user to easily replace or retrofit a bottle jack with the compression spring.

In addition, the compression spring 58 concentrically encloses the pump rod and pump cylinder assembly 16 and is positioned parallel the pump longitudinal axis 18 so as to provide stability and integrality as shown in FIGS. 1–6. The compression spring 58 is capable of vertical translation or stroke, as shown as arrow F in FIGS. 4 and 8, in the plane 34 parallel the pump longitudinal axis 18 as the handle 12 is vertically translated and rotated, arrow A, between the upper position 48 and the lower position 50 and as the pump rod and pump cylinder assembly 16 reciprocates, arrow H. This reciprocation thereby changes the variable triangle 52 back and forth between the oblique angled triangular shape 54 and the acute angled triangular shape 52 respectively as loads 64 on the handle 12 are transferred to the pump rod and pump cylinder assembly 16 and as the compression spring 58 subsequently returns the handle to the upper position 48.

The problems of the prior art are therefore overcome by my invention as the compression spring 58 urges the handle 12 and the spring collar yoke 42 upwards (arrows A and D, as shown in FIGS. 3 and 4, thereby creating a negative pressure 66 (not shown) within the pump rod and pump cylinder assembly 16 and thereby drawing the fluid 14, as shown in FIG. 3 by arrow G and as detailed below, into the pump rod and pump cylinder assembly 16 as the handle 12 returns to the upper position 48. The compression spring 58 and the spring yoke collar 42 thereby forming an integral part of the improved bottle jack 10 to automatically return the handle 12 to the upper position 48 from the lower position 50 thereby creating the oblique angled triangular shape 54 and to automatically recharge the pump rod and pump cylinder assembly 16 with the fluid 14.

Figure 8:
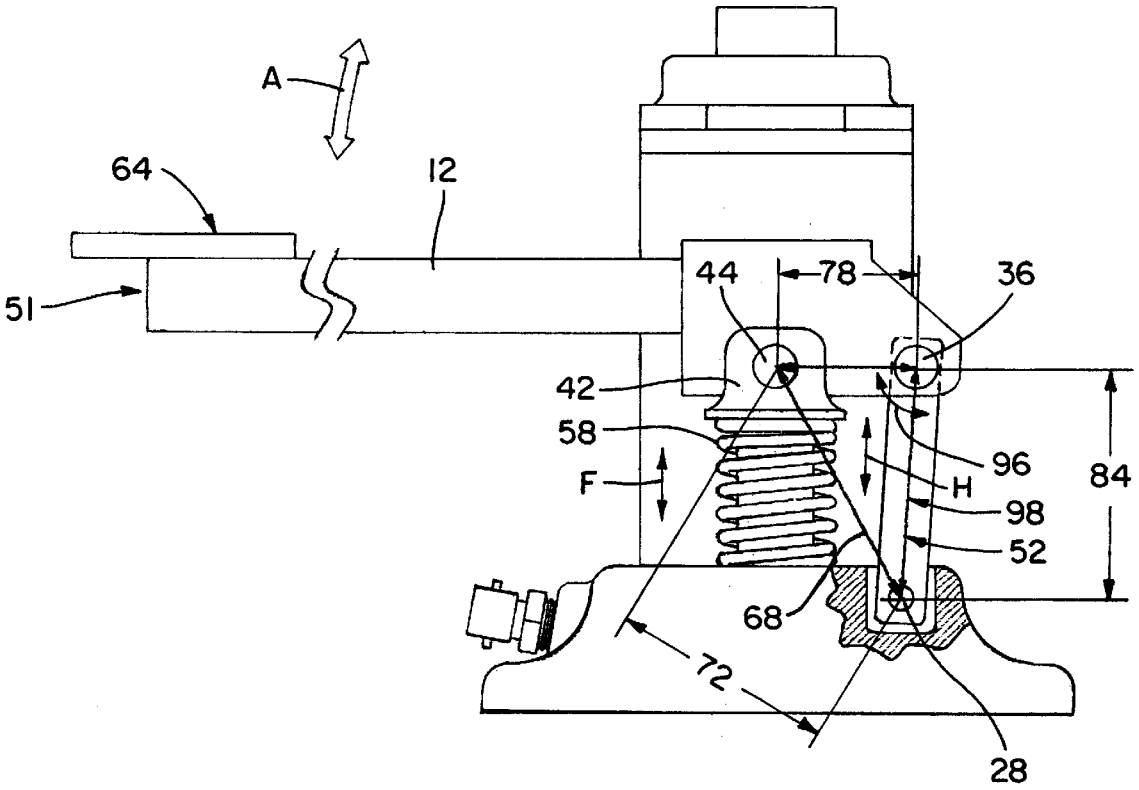
FIG. 8 is a side view of the improved bottle jack of FIG. 4 with the handle being located in an intermediate position and showing the variable triangle having a right angled triangular shape.
Figure 9:
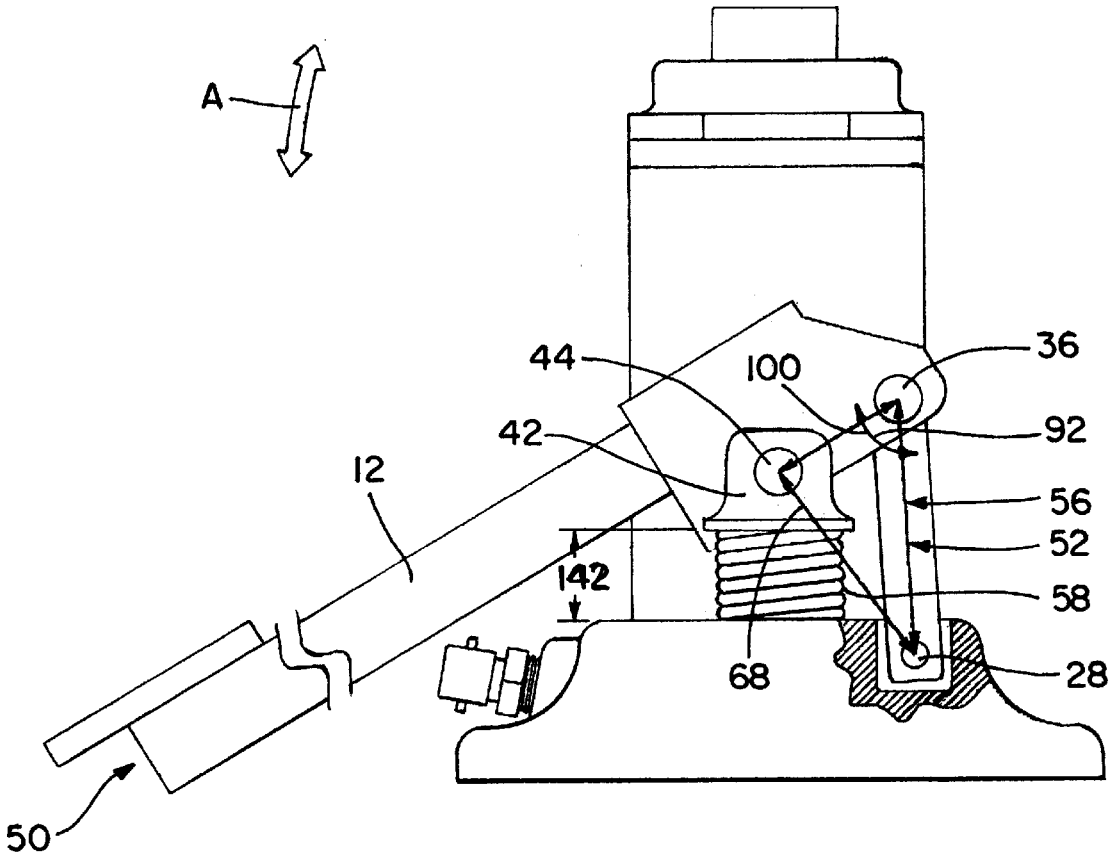
FIG. 9 is a side view of the improved bottle jack of FIG. 4 with the handle being located in the lower position and showing an acute angled triangular shape.

Now in further analysis of the workings of my invention and in further describing the geometrical dynamics of my invention, the pump rod pin 44 and the lower anchor rod pin 28 form a variable vector 68 as shown in FIGS. 7–9. The variable vector 68 has a variable vector direction 70 and a variable vector magnitude 72 as shown in FIGS. 7–9 and the variableness of this vector shall be shown as the variable triangle changes.

The pump rod pin 44 and the upper anchor rod pin 36 form a first fixed vector 74, shown in FIGS. 7–9, and the first fixed vector has a first vector direction 76 and a first fixed vector magnitude 78. In the preferred embodiment, the first fixed vector magnitude measures 1.2 inches. In addition, the upper anchor rod pin 36 and the lower anchor rod pin 26 form a second fixed vector 80, also shown in FIGS. 7–9, and the second fixed vector has a second vector direction 82 and a second fixed vector magnitude 84. In the preferred embodiment, the second fixed vector magnitude measures 2.95 inches.

The vertical translation of the handle 12, arrow A, and the compression spring 58, arrow F, as the pump rod and pump cylinder assembly 16 reciprocates as shown by an arrow H in FIG. 4. This reciprocation and the vertical translations thereby cause the variable vector magnitude 72 and the variable vector direction 70 to vary and the first vector direction 76 and the second vector direction 82 each to subsequently vary as the variable triangle 52 changes back and forth between the oblique angled triangular shape 54 and the acute angled triangular shape 56, as shown in FIGS. 7–9, as loads 64 on the handle 12 are applied and as the handle 12 is thereafter urged, arrow A, towards the upper position 48 by the compression spring 58 as shown in FIG. 7. In the preferred embodiment, the variable vector magnitude 72 measures 3.7337 inches when the variable triangle has the oblique angled triangular shape, 3.1476 inches when right angled triangular shaped, and 2.8923 inches when acute angled triangular shaped.

For clarification purposes also as shown in FIGS. 7–9 by the double arrowed vectors, the variable vector 68 has a second variable vector direction 86 having a 180 degree opposite direction to the variable vector direction 70. The first fixed vector 74 has a first opposite vector direction 88 having a 180 degree opposite direction to the first vector direction 76. Finally, the second fixed vector 80 has a second opposite vector direction 90 having a 180 degree opposite direction to the second vector direction 82. The double arrows shows that the magnitudes and directions can be viewed from either direction of the vector's arrows.

Again, looking at FIGS. 7–9, an angle 92 is formed between the first fixed vector 74 and the second fixed vector 80 at the upper anchor rod pin 36. The angle 92 will vary (as well as the variable triangle 52 will vary) as the handle 12 is vertically translated and rotated, arrow A, and interacts with the spring collar yoke 42, the compression spring 58, and the pump rod and pump cylinder assembly 16.

First, as shown in FIG. 7, the angle 92 has an obtuse value 94 when the variable triangle 52 has the oblique angled triangular shape 54. Next, the angle 92 will have a 90 degree value 96 when the variable triangle 52 has a right angled triangular shape 98, as shown in FIG. 8. Lastly, the angle 92 will have an acute value 100 when the variable triangle 52 has the acute angled triangular shape 56 as shown in FIG. 9. In the preferred embodiment, the angle 92 will measure 122 degrees in the oblique angled triangular shape 54 and the angle will measure 76 degrees in the acute angled triangular shape 56.

The variable triangle 52 therefore has the right angled triangular shape 98 during the back and forth changes between the oblique angled triangular shape 54 and the acute angled triangular shape 56 as the handle 12 is vertically translated and rotated, arrow A. In addition as shown in FIG. 4, in the preferred embodiment, the variance of the variable triangle 52 is reflected in the fall 3 degree rotation (arrow B) of the anchor rod 22 and the and 0.1719 inch travel of the upper anchor rod end 26 during the back and forth changes, with the anchor rod 22 being located 1 degree left of a centerline 101 at the 122 degree angle, 2 degrees right of the centerline at the right angle, and 1 degree left of centerline at the 76 degree angle.

In the geometry, the upper anchor rod pin 36 is also located a variable perpendicular distance 102 measured from the upper anchor rod pin axis 40 to the pump longitudinal axis 18, as shown in FIG. 4. The variable perpendicular distance 102 varies between a minimum value 106 when the variable triangle 52 has the oblique angled triangular shape 54 and a maximum value 108 when the variable triangle 52 has the right angled triangular shape 98 and the upper anchor rod pin 36 is at an apex 110. In the preferred embodiment, variable perpendicular distance 102 measures 1.0281 inches when at the oblique angled triangular shape 54, 1.2 inches at the right angled triangular shape 98, and 1.1683 inches at the acute angled triangular shape 56.

The improved bottle jack 10 further includes a handle bracket 112 for removably attaching the handle 12 to the pump rod and pump cylinder assembly 16, The spring collar yoke 42, and the anchor rod 22, as shown in FIGS. 1–2, 5–6. The handle bracket 112 has a first handle bracket hole 114 for removably receiving the pump rod pin 44 and the handle bracket having a second handle bracket hole 116 located opposite the first handle bracket hole for removably receiving the upper anchor rod pin 36, as shown in FIGS. 1 and 6. The handle bracket 112 is capable of rotation about the pump rod pin axis 46, arrow E, and about the upper anchor rod pin axis 40, arrow C, the rotations occurring in the plane 34 parallel the pump longitudinal axis 18 (in the plane of the paper).

One of the key features, the spring collar yoke 42, has a spring pocket 118 for removably and operatively securing the upper spring end 62 of the compression spring 58, as shown in FIG. 3. The spring pocket 118 has an inner diameter 118 is sized and configured to receive the compression spring 58 and to concentrically enclose the pump rod and pump cylinder assembly 16, again as shown in FIG. 3. The compression spring 58 is sized and configured so that both the compression spring and the spring collar yoke 42 can vertically translate, arrows D and F, about the pump rod and pump cylinder assembly 16.

The spring collar yoke 42 has a spring collar hole 122, shown in FIGS. 1 and 5, for removably receiving the pump rod pin 44 and the spring collar yoke 42 is pivotably connected to the handle bracket 112 and to the pump rod and pump cylinder assembly 16 by the pump rod pin 44, as shown in FIG. 6. A key feature of the spring collar yoke 42, as shown in FIG. 3, is that the spring collar yoke concentrically aligns 61 the compression spring 58 about the pump rod and pump cylinder assembly 16 so that the compression spring does not flex transversely or buckle about the pump longitudinal axis 18.

Furthermore, the handle bracket 112 further includes a mechanical stop 122, as shown in FIGS. 1 and 5, for limiting the vertical translation, arrow A, of the handle 12 and the vertical translation and stroke, arrows A, F and H, of the compression spring 58, the handle 12, and the pump rod and pump cylinder assembly 18. The mechanical stop 122 maintains the compression spring 58 in a preloaded state 124, shown in FIG. 7, when the handle 12 is in the upper position 48. The mechanical stop 122 is located between the first handle bracket hole 114 and the second handle bracket hole 116, as shown in FIG. 1, and is sized and positioned to engage the anchor rod 22 when the handle 12 has reached the upper position 48, as shown in FIG. 7. The mechanical stop 122 maintains the compression spring 58 under compression when the mechanical stop 122 is engaged by the anchor rod 22.

As to rotation, the anchor rod 22 rotates about the lower anchor rod pin axis 32, arrow B in FIG. 4, at a lower anchor rod angle 126 having a value between 3 and 10 degrees with the rotation being 3 degrees in the preferred embodiment. The handle 12 rotates about the upper anchor rod pin axis 40, arrow C in FIG. 4, at an upper anchor rod angle 128 having a value of approximately 46 degrees with 46 degrees being the value in the preferred embodiment. The value of the angle 128 will depend greatly on the lengths of the pump rod and pump cylinder assembly, the anchor rod, and the handle bracket, as well as the geometry of pump action. The rotation of the anchor rod 22 and the handle 12 being due to the reciprocation of the loads 64 on the handle and subsequent return of the handle to the upper position 48 due to the compression spring 58.

Now, as shown in FIG. 3, the pump rod and pump cylinder assembly 16 further includes a pump chamber 130, a pump rod 132 housed within the pump chamber, and a pump passageway P2 connected to the pump chamber 130. A rubber seal 131 is also included. It is noted that the structure and the mechanics of the pump chamber 130, the pump rod 132, and the pump passageway P2 follows that which has been taught in the prior art pump and piston mechanisms and that which one of ordinary skill in the art will understand. Namely, as shown in FIG. 3, check balls B1, B2, and B3, ball seats 202, storage reservoirs 204, and fluid passageways P1, P3, and P4 all interact to increase or to decrease volume displacement within the pump chamber 130. This volume displacement either creates the negative pressure 66 (not shown) as the volume displacement increases and as fluid 14 is drawn into the pump chamber 130 or it creates a positive pressure as fluid is expelled from the pump chamber 130 into the area below a piston 206, shown in FIG. 3 in order to raise the piston of the jack, as the volume displacement decreases. The creation of the negative pressure 66 is also known as charging the pump chamber 130 or the pump means 16.

In operation, the handle bracket 112 and the spring collar yoke 42 both are pivotably connected, arrows C and D, to the pump rod 132 by the pump rod pin 44, as in FIG. 6. The pump passageway P2 feeds the fluid 14 to and from the pump chamber 130 in response to the vertical translation, arrows A and H, of the handle 12 and the pump rod 132 along the pump longitudinal axis 18. The compression spring 58 urges the handle 12 and the pump rod 132 upwards, as shown in FIGS. 4 and 7, thereby creating a negative pressure 66 (not shown) within the pump chamber 130 and thereby drawing the fluid 14 from the pump passageway P2 into the pump chamber 130 as the handle 12 returns to the upper position 48. The compression spring, therefore, being sized and configured so as to overcome any downward forces on the pump rod 132 so as to push the handle upwards. This operation of the compression spring 58 on the spring collar yoke 42 and in turn onto the handle 12 and pump rod 132 forms the integral operation of the improved bottle jack 10, and shows the integrality of the compression spring and the spring collar yoke to the improved bottle jack.

In the preferred embodiment, the compression spring 58 is of a closed and ground ends type in order to direct the vertical translation, arrow F, of the compression spring along the pump longitudinal axis 18. The compression spring is constructed of zinc-plated high carbon steel and the preloaded state 124, shown in FIG. 7, has a value of 30% in order to thereby maintain a uniform spring loaded pressure on the compression spring and to prevent any slack in the handle-to-spring connection as the handle 12 is vertically translated, arrow A, between the upper position 48 and the lower position 50.

Furthermore in the preferred embodiment and as shown in FIGS. 2, 3, 5, and 6, the compression spring 58 has a wire diameter 136 measuring 0.150 inch, a free spring length 138 measuring 3 inches, an outer spring diameter 140 measuring 1.25 inches, a full spring compressed length 142 measuring 1.35 inches (FIG. 9), and a preloaded spring length 144 measuring 2.5 inches (FIG. 7). The compression spring 58 has a 75 pound force rating and the compression spring and the pump rod 132 have a pump travel to spring compression ratio measuring 54%. The compression spring will have therefore traveled 1.65 inches and the pump rod, 0.893 inches, along the pump longitudinal axis 18.

An additional key feature of my invention as mention earlier, is in the ability to retrofit an existing bottle jack with the compression spring 58 and the corresponding spring collar yoke 42. In operation, as shown in FIGS. 5 and 6, one will understand a method of retrofitting a bottle jack to create the improved bottle jack.

The method comprises the steps of: (a) removing a rod pin 104 (not shown) from the handle 12 and pump means 16; (b) detaching the handle 12 from the pump means 16 thereby exposing the pump means; (c) concentrically placing the compression spring 58 over the exposed pump means 16 thereby circumferentially enclosing the pump means with the compression spring; (d) placing the spring collar yoke 42 over the placed compression spring and circumferentially enclosed pump means so as to align the compression spring over the pump means; (e) replacing the handle 12 on the circumferentially enclosed pump means 16; and (f) placing the pump rod pin 44 on the replaced handle 12 and circumferentially enclosed pump means 16 thereby connecting the spring collar yoke 42 and the compression spring 58 to the replaced handle and circumferentially enclosed pump means. This method thereby creates the means in the improved bottle jack 10 to automatically return the replaced handle 12 to the upper position 48 and to automatically recharge, by negative pressure 66, the circumferentially enclosed pump means 16 with the fluid 14.

Additionally as shown in FIGS. 5 and 6, the step of removing the rod pin 104 further comprises the steps of removing the upper anchor rod pin 36 from the handle 12 and detaching the handle from the anchor rod 22 prior to detaching the handle from the pump means 16. This thereby allows the complete removal of the handle 12 prior to the concentric placing of the compression spring 58 over the pump means 16.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

I claim:

1. A bottle jack having a handle, fluid, and a pump rod and pump cylinder assembly, the pump rod and pump cylinder assembly having a pump longitudinal axis, the bottle jack comprising:

a base, the pump rod and pump cylinder assembly being fixedly connected to the base;

an anchor rod being located proximate the pump rod and pump cylinder assembly and parallel the pump longitudinal axis;

a spring collar yoke being removably and pivotably connected to the handle and to the pump rod and pump cylinder assembly by a pump rod pin, the spring collar yoke for concentrically enclosing the pump rod and pump cylinder assembly, the pump rod pin having a pump rod pin axis positioned perpendicular to the pump longitudinal axis; and a compression spring having a lower spring end and an upper spring end, the compression spring being removably and operatively connected to the base at the lower spring end, the compression spring being removably and operatively connected to the spring collar yoke at the upper spring end for aligning the compression spring, the compression spring concentrically enclosing the pump rod and pump cylinder assembly and being positioned parallel the pump longitudinal axis, the spring collar yoke having a spring pocket configured for removably enclosing and securing the upper spring end of the compression spring, the spring pocket having an inner diameter being sized and configured for receiving the upper spring end of the compression spring and for concentrically enclosing the pump rod and pump cylinder assembly and the compression spring being sized and configured for vertically translating both the compression spring and the spring collar yoke about the pump rod and pump cylinder assembly the spring collar yoke for concentrically aligning the compression spring about the pump rod and pump cylinder assembly.

2. The bottle jack of claim 1, further comprising a handle bracket for attaching the handle to the pump rod and pump cylinder assembly, the spring collar yoke having a spring collar hole for removably receiving the pump rod pin, the spring collar yoke being pivotably connected to the handle bracket and the pump rod and pump cylinder assembly by the pump rod pin.

3. In combination, an improved bottle jack having a handle, fluid, and a pump rod and pump cylinder assembly, the pump rod and pump cylinder assembly having a pump longitudinal axis, the combination comprising:

a base, the pump rod and pump cylinder assembly being fixedly connected to the base;

an anchor rod being located proximate the pump rod and pump cylinder assembly and parallel the pump longitudinal axis, the anchor rod having a lower anchor rod end and an upper anchor rod end being located opposite the lower anchor rod end, the anchor rod being pivotably connected to the base at the lower anchor rod end by a lower anchor rod pin, the lower anchor rod pin being positioned at a fixed lower distance from the pump rod and pump cylinder assembly, the lower anchor rod pin having a lower anchor rod pin axis being fixedly located and positioned perpendicular relative to the pump longitudinal axis, the anchor rod being capable of rotation about the lower anchor rod pin axis in a plane parallel the pump longitudinal axis, the handle being pivotably connected to the anchor rod at the upper anchor rod end by an upper anchor rod pin, the upper anchor rod pin being positioned at a variable upper distance from the pump rod and pump cylinder assembly, the upper anchor rod pin having an upper anchor rod pin axis being variably located and positioned perpendicular relative to the pump longitudinal axis, the handle being capable of rotation about the upper anchor rod pin axis in the plane parallel the pump longitudinal axis;

a spring collar yoke being removably and pivotably connected to the handle and to the pump rod and pump cylinder assembly by a pump rod pin, the spring collar yoke capable of concentrically enclosing the pump rod and pump cylinder assembly, the pump rod pin having a pump rod pin axis being fixedly located and positioned perpendicular relative to the pump longitudinal axis, the pump rod pin being located a fixed distance from the upper anchor rod pin, the upper anchor rod pin being located a fixed distance from the lower anchor rod pin, the spring collar yoke and the pump rod pin axis being capable of vertical translation about the pump rod and pump cylinder assembly when the handle is vertically translated and rotated between an upper position and a lower position, the handle and the spring collar yoke each being capable of rotation about the pump rod pin axis in the plane parallel the pump longitudinal axis, the spring collar yoke being located proximate the upper anchor rod end and the upper anchor rod pin, the pump rod pin and the lower anchor rod pin and the upper anchor rod pin each forming a corner of a variable triangle, the variable triangle being located in the plane parallel the pump longitudinal axis and being capable of changing back and forth between an oblique angled triangular shape and an acute angled triangular shape as the handle is vertically translated and rotated between the upper position and the lower position respectively; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump rod and pump cylinder assembly and being positioned parallel the pump longitudinal axis, the compression spring being capable of vertical translation in the plane parallel the pump longitudinal axis as the handle is vertically translated and rotated between the upper position and the lower position and as the pump rod and pump cylinder assembly reciprocates for changing the variable triangle back and forth between the oblique angled triangular shape and the acute angled triangular shape respectively as loads on the handle are transferred to the pump rod and pump cylinder assembly and as the compression spring returns the handle to the upper position, the compression spring urging the handle and the spring collar yoke upwards for creating a negative pressure within the pump rod and pump cylinder assembly and for drawing the fluid into the pump rod and pump cylinder assembly as the handle returns to the upper position, the compression spring and the spring yoke collar forming an integral part of the improved bottle jack to automatically return the handle to the upper position from the lower position for creating the oblique angled triangular shape and to automatically recharge the pump rod and pump cylinder assembly with the fluid, the pump rod pin and the lower anchor rod pin forming a variable vector, the variable vector having a variable vector direction and a variable vector magnitude, the pump rod pin and the upper anchor rod pin forming a first fixed vector, the first fixed vector having a first vector direction and a first fixed vector magnitude, and the upper anchor rod pin and the lower anchor rod pin forming a second fixed vector, the second fixed vector having a second vector direction and a second fixed vector magnitude, the vertical translation of the handle and the compression spring as the pump rod and pump cylinder assembly reciprocates for causing the variable vector magnitude and the variable vector direction to vary and the first vector direction and the second vector direction each to subsequently vary as the variable triangle changes back and forth between the oblique angled triangular shape and the acute angled triangular shape as loads on the handle are applied and as the handle is thereafter urged towards the upper position by the compression spring, the variable vector having a second variable vector direction having a 180 degree opposite direction to the variable vector direction, the first fixed vector having a first opposite vector direction having a 180 degree opposite direction to the first vector direction, and the second fixed vector having a second opposite vector direction having a 180 degree opposite direction to the second vector direction, an angle forming between the first fixed vector and the second fixed vector at the upper anchor rod pin has an obtuse value when the variable triangle has the oblique angled triangular shape, a 90 degree value when the variable triangle has a right angled triangular shape, and an acute value when the variable triangle has the acute angled triangular shape, the variable triangle having the right angled triangular shape during the back and forth changes between the oblique angled triangular shape and the acute angled triangular shape, the upper anchor rod pin being located a variable perpendicular distance from the upper anchor rod pin axis to the pump longitudinal axis, the variable perpendicular distance varying between a minimum value when the variable triangle has the oblique angled triangular shape and a maximum value when the variable triangle has the right angled triangular shape and the upper anchor rod pin is at an apex, the improved bottle jack further including a handle bracket for removably attaching the handle to the pump rod and pump cylinder assembly, the spring collar yoke, and the anchor rod, the handle bracket having a first handle bracket hole for removably receiving the pump rod pin, the handle bracket having a second handle bracket hole located opposite the first handle bracket hole for removably receiving the upper anchor rod pin, the handle bracket being capable of rotation about the pump rod pin axis and about the upper anchor rod pin axis, the rotations occurring in the plane parallel the pump longitudinal axis, the spring collar yoke having a spring pocket for removably and operatively securing the upper spring end of the compression spring, the spring pocket having an inner diameter being sized and configured for receiving the compression spring and for concentrically enclosing the pump rod and pump cylinder assembly and the compression spring being sized and configured for vertically translating both the compression spring and the spring collar yoke about the pump rod and pump cylinder assembly, the spring collar yoke having a spring collar hole for removably receiving the pump rod pin, the spring collar yoke being pivotably connected to the handle bracket and the pump rod and pump cylinder assembly by the pump rod pin, the spring collar yoke for concentrically aligning the compression spring about the pump rod and pump cylinder assembly, the handle bracket further including a mechanical stop for limiting the vertical translation of the handle and the vertical translation and stroke of the compression spring and the handle and the pump rod and pump cylinder assembly, the mechanical stop for maintaining the compression spring in a preloaded state when the handle is in the upper position, the mechanical stop being located between the first handle bracket hole and the second handle bracket hole, the mechanical stop being sized and positioned for engaging the anchor rod when the handle has reached the upper position, the mechanical stop for maintaining the compression spring under compression when the mechanical stop is engaged by the anchor rod.

4. The combination of claim 3, wherein the anchor rod rotates about the lower anchor rod pin axis at a lower anchor rod angle having a value between 3 and 10 degrees, the handle rotating about the upper anchor rod pin axis at an upper anchor rod angle having a value of approximately 46 degrees, the rotation of the anchor rod and the handle being due to the reciprocation of the loads on the handle and subsequent return of the handle to the upper position due to the compression spring.

5. The combination of claim 4, wherein the pump rod and pump cylinder assembly further includes a pump chamber, a pump rod housed within the pump chamber, and a pump passageway connected to the pump chamber, the handle bracket and the spring collar yoke both being pivotably connected to the pump rod by the pump rod pin, the pump passageway feeding the fluid to and from the pump chamber in response to the vertical translation of the handle and the pump rod along the pump longitudinal axis, the compression spring for urging the handle and the pump rod upwards for creating a negative pressure within the pump chamber and for drawing the fluid from the pump passageway into the pump chamber as the handle returns to the upper position.

6. The combination of claim 5, wherein the compression spring is configured for directing the vertical translation of the compression spring along the pump longitudinal axis, the compression spring being constructed of zinc-plated high carbon steel, the preloaded state having a value of 30% for maintaining a uniform spring loaded pressure as the handle is vertically translated between the upper position and the lower position.

7. The combination of claim 6, wherein the compression spring has a wire diameter measuring 0.150 inch, a free spring length measuring 3 inches, an outer spring diameter measuring 1.25 inches, a fill spring compressed length measuring 1.35 inches, and a preloaded spring length measuring 2.5 inches, the compression spring having a 75 pound force rating, the compression spring and the pump rod having a pump travel to spring compression ratio measuring 54%.

8. In combination, an improved bottle jack having a handle, fluid, and pump means, the combination comprising:

a base, the pump means being operatively connected to the base;

an anchor rod having a lower anchor rod end and an upper anchor rod end being located opposite the lower anchor rod end, the anchor rod being located proximate the pump means and being pivotably connected to the base at the lower anchor rod end, the handle being pivotably connected to the anchor rod at the upper anchor rod end;

a spring collar yoke being removably and pivotably connected to the handle and to the pump means, the spring collar yoke being located proximate the upper anchor rod end, the spring collar yoke being capable of concentrically enclosing the pump means; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump means, the compression spring being capable of vertical translation as the handle is vertically translated between an upper position and a lower position as loads on the handle are transferred to the pump means and as the pump means reciprocates and as the compression spring returns the handle to the upper position, the compression spring urging the handle and the spring collar yoke upwards for creating a negative pressure within the pump means and for drawing the fluid into the pump means as the handle returns to the upper position, the compression spring and the spring yoke collar forming an integral part of the improved bottle jack for automatically returning the handle to the upper position from the lower position and for automatically recharging the pump means with the fluid, the improved bottle jack further including a handle bracket for removably attaching the handle to the pump means, the spring collar yoke, and the anchor rod, the handle bracket having a first handle bracket hole for removably receiving a pump rod pin, the handle bracket having a second handle bracket hole located opposite the first handle bracket hole for removably receiving an upper anchor rod pin, the handle bracket being capable of rotation about a pump rod pin axis and about an upper anchor rod pin axis, the rotations occurring in a plane parallel a pump longitudinal axis, the spring collar yoke having a spring pocket for removably and operatively securing the upper spring end of the compression spring, the spring pocket having an inner diameter being sized and configured for receiving the compression spring and for concentrically enclosing the pump means and the compression spring being sized and configured for vertically translating both the compression spring and the spring collar yoke about the pump means, the spring collar yoke having a spring collar hole for removably receiving the pump rod pin, the spring collar yoke being pivotably connected to the handle bracket and the pump means by the pump rod pin, the spring collar yoke for concentrically aligning the compression spring about the pump means.

9. In combination, an improved bottle jack having a handle, fluid, and pump means, the combination comprising:

a base, the pump means being operatively connected to the base;

an anchor rod having a lower anchor rod end and an upper anchor rod end being located opposite the lower anchor rod end, the anchor rod being located proximate the pump means and being pivotably connected to the base at the lower anchor rod end, the handle being pivotably connected to the anchor rod at the upper anchor rod end;

a spring collar yoke being removably and pivotably connected to the handle and to the pump means, the spring collar yoke being located proximate the upper anchor rod end, the spring collar yoke being capable of concentrically enclosing the pump means; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump means, the compression spring being capable of vertical translation as the handle is vertically translated between an upper position and a lower position as loads on the handle are transferred to the pump means and as the pump means reciprocates and as the compression spring returns the handle to the upper position, the compression spring urging the handle and the spring collar yoke upwards for creating a negative pressure within the pump means and for drawing the fluid into the pump means as the handle returns to the upper position, the compression spring and the spring yoke collar forming an integral part of the improved bottle jack for automatically returning the handle to the upper position from the lower position and for automatically recharging the pump means with the fluid, the improved bottle jack further including a handle bracket for removably attaching the handle to the pump means, the spring collar yoke, and the anchor rod, the handle bracket having a first handle bracket hole for removably receiving a pump rod pin, the handle bracket having a second handle bracket hole located opposite the first handle bracket hole for removably receiving an upper anchor rod pin, the handle bracket being capable of rotation about a pump rod pin axis and about an upper anchor rod pin axis, the rotations occurring in a plane parallel a pump longitudinal axis, the handle bracket further including a mechanical stop for limiting the vertical translation of the handle and the vertical translation and stroke of the compression spring and the handle and the pump means, the mechanical stop for maintaining the compression spring in a preloaded state when the handle is in the upper position, the mechanical stop being located between the first handle bracket hole and the second handle bracket hole, the mechanical stop being sized and for engaging the anchor rod when the handle has reached the upper position, the mechanical stop for maintaining the compression spring under compression when the mechanical stop is engaged by the anchor rod.

10. In combination, an improved bottle jack having a handle, fluid, and pump means, the combination comprising:

a base, the pump means being operatively connected to the base;

an anchor rod having a lower anchor rod end and an upper anchor rod end being located opposite the lower anchor rod end, the anchor rod being located proximate the pump means and being pivotably connected to the base at the lower anchor rod end, the handle being pivotably connected to the anchor rod at the upper anchor rod end;

a spring collar yoke being removably and pivotably connected to the handle and to the pump means, the spring collar yoke being located proximate the upper anchor rod end, the spring collar yoke being capable of concentrically enclosing the pump means; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump means, the compression spring being capable of vertical translation as the handle is vertically translated between an upper position and a lower position as loads on the handle are transferred to the pump means and as the pump means reciprocates and as the compression spring returns the handle to the upper position, the compression spring urging the handle and the spring collar yoke upwards for creating a negative pressure within the pump means and for drawing the fluid into the pump means as the handle returns to the upper position, the compression spring and the spring yoke collar forming an integral part of the improved bottle jack for automatically returning the handle to the upper position from the lower position and for automatically recharging the pump means with the fluid, the improved bottle jack further including a handle bracket for removably attaching the handle to the pump means, the spring collar yoke, and the anchor rod, the handle bracket having a first handle bracket hole for removably receiving a pump rod pin, the handle bracket having a second handle bracket hole located opposite the first handle bracket hole for removably receiving an upper anchor rod pin the handle bracket being capable of rotation about a pump rod pin axis and about an upper anchor rod pin axis, the rotations occurring in a plane parallel a pump longitudinal axis, the anchor rod rotates about a lower anchor rod pin axis at a lower anchor rod angle having a value between 3 and 10 degrees, the handle rotating about the upper anchor rod pin axis at an upper anchor rod angle having a value of approximately 46 degrees, the rotation of the anchor rod and the handle being due to the reciprocation of the loads on the handle and subsequent return of the handle to the upper position due to the compression spring.

11. In combination, an improved bottle jack having a handle, fluid, and pump means, the combination comprising:

a base, the pump means being operatively connected to the base;

an anchor rod having a lower anchor rod end and an upper anchor rod end being located opposite the lower anchor rod end, the anchor rod being located proximate the pump means and being pivotably connected to the base at the lower anchor rod end, the handle being pivotably connected to the anchor rod at the upper anchor rod end;

a spring collar Yoke being removably and pivotably connected to the handle and to the pump means, the spring collar yoke being located proximate the upper anchor rod end, the spring collar yoke being capable of concentrically enclosing the pump means; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump means, the compression spring being capable of vertical translation as the handle is vertically translated between an upper position and a lower position as loads on the handle are transferred to the pump means and as the pump means reciprocates and as the compression spring returns the handle to the upper position, the compression spring urging the handle and the spring collar yoke upwards for creating a negative pressure within the pump means and for drawing the fluid into the pump means as the handle returns to the upper position, the compression spring and the spring yoke collar forming an integral part of the improved bottle jack for automatically returning the handle to the upper position from the lower position and for automatically recharging the pump means with the fluid, the improved bottle jack further including a handle bracket for removably attaching the handle to the pump means, the spring collar yoke, and the anchor rod, the handle bracket having a first handle bracket hole for removably receiving a pump rod pin, the handle bracket having a second handle bracket hole located opposite the first handle bracket hole for removably receiving an upper anchor rod pin, the handle bracket being capable of rotation about a pump rod sin axis and about an upper anchor rod pin axis, the rotations occurring in a plane parallel a pump longitudinal axis, the pump means further including a pump chamber, a pump rod housed within the pump chamber, and a pump passageway connected to the pump chamber, the handle bracket and the spring collar yoke both being pivotably connected to the pump rod by the pump rod pin, the pump passageway for feeding the fluid to and from the pump chamber in response to the vertical translation of the handle and the pump rod along the pump longitudinal axis, the compression spring for urging the handle and the pump rod upwards for creating a negative pressure within the pump chamber and for drawing the fluid from the pump passageway into the pump chamber as the handle returns to the upper position.

12. The combination of claim 9, wherein the compression spring is configured for directing the vertical translation of the compression spring along the pump longitudinal axis, the compression spring being constructed of zinc-plated high carbon steel, the preloaded state having a value of 30% for maintaining a uniform spring loaded pressure as the handle is vertically translated between the upper position and the lower position.

13. The combination of claim 12, wherein the compression spring has a wire diameter measuring 0.150 inch, a free spring length measuring 3 inches, an outer spring diameter measuring 1.25 inches, a full spring compressed length measuring 1.35 inches, and a preloaded spring length measuring 2.5 inches, the compression spring having a 75 pound force rating, the compression spring and a pump rod having a pump travel to spring compression ratio measuring 54%.

14. An improved bottle jack having a handle, fluid, and pump means, the pump means having a pump longitudinal axis, the improved bottle jack comprising:

a base, the pump means being operatively connected to the base;

an anchor rod having a lower anchor rod end and an upper anchor rod end being located opposite the lower anchor rod end, the anchor rod being located proximate the pump means and being pivotably connected to the base at the lower anchor rod end by a lower anchor rod pin, the handle being pivotably connected to the anchor rod at the upper anchor rod end by an upper anchor rod pin;

a spring collar yoke being removably and pivotably connected to the handle and to the pump means by a pump rod pin, the spring collar yoke being located proximate the upper anchor rod end, the spring collar yoke being capable of concentrically enclosing the pump means, the pump rod pin being located a fixed distance from the upper anchor rod pin, the upper anchor rod pin being located a fixed distance from the lower anchor rod pin, the pump rod pin and the lower anchor rod pin and the upper anchor rod pin each forming a corner of a variable triangle, the variable triangle being located in a plane parallel the pump longitudinal axis and being capable of changing back and forth between an oblique angled triangular shape and an acute angled triangular shape as the handle is vertically translated and rotated between an upper position and a lower position respectively; and a compression spring having a lower spring end and an upper spring end being located opposite the lower spring end, the compression spring being removably and operatively connected to the base at the lower spring end, the compression spring being removably and operatively connected to the spring collar yoke at the upper spring end for aligning the compression spring, the compression spring concentrically enclosing the pump means and being positioned parallel the pump longitudinal axis, the compression spring being capable of vertical translation in the plane parallel the pump longitudinal axis as the handle is vertically translated between the upper position and the lower position and as the pump means reciprocates thereby changing the variable triangle back and forth between the oblique angled triangular shape and the acute angled triangular shape as loads on the handle are transferred to the sump means and as the compression spring returns the handle to the upper position, the compression spring for urging the handle and the spring collar yoke upwards for creating a negative pressure within the pump means and for drawing the fluid into the pump means as the handle returns to the upper position, the compression spring and the spring yoke collar forming an integral part of the improved bottle jack for automatically returning the handle to the upper position from the lower position and for automatically recharging the pump means with the fluid, the improved bottle jack further including a handle bracket for removably attaching the handle to the pump means, the spring collar yoke, and the anchor rod, the handle bracket having a first handle bracket hole for removably receiving the pump rod pin, the handle bracket having a second handle bracket hole located opposite the first handle bracket hole for removably receiving the upper anchor rod pin, the handle bracket being capable of rotation about a pump rod pin axis and about an upper anchor rod pin axis, the rotations occurring in the plane parallel the pump longitudinal axis, the spring collar yoke having a spring pocket for removably and operatively securing the upper spring end of the compression spring, the spring pocket having an inner diameter being sized and configured for receiving the compression spring and for concentrically enclosing the pump means, and the compression spring being sized and configured for vertically translating both the compression spring and the spring collar yoke about the pump means, the spring collar yoke having a spring collar hole for removably receiving the pump rod pin, the spring collar yoke being pivotably connected to the handle bracket and the pump means by the pump rod pin, the spring collar yoke for concentrically aligning the compression spring about the pump means.

the handle bracket further including a mechanical stop for limiting the vertical translation of the handle and the vertical translation and stroke of the compression spring and the handle and the pump means, the mechanical stop for maintaining the compression spring in a preloaded state when the handle is in the upper position, the mechanical stop being located between the first handle bracket hole and the second handle bracket hole, the mechanical stop being sized and positioned for engaging the anchor rod when the handle has reached the upper position, the mechanical stop for maintaining the compression spring under compression when the mechanical stop is engaged by the anchor rod.

15. The improved bottle jack of claim 14, wherein the anchor rod rotates about a lower anchor rod pin axis at a lower anchor rod angle having a value between 3 and 10 degrees, the handle rotating about an upper anchor rod pin axis at an upper anchor rod angle having a value of approximately 46 degrees, the rotation of the anchor rod and the handle being due to the reciprocation of the loads on the handle and subsequent return of the handle to the upper position due to the compression spring.

16. The improved bottle jack of claim 15, wherein the pump means further includes a pump chamber, a pump rod housed within the pump chamber, and a pump passageway connected to the pump chamber, the handle bracket and the spring collar yoke both being pivotably connected to the pump rod by the pump rod pin, the pump passageway for feeding the fluid to and from the pump chamber in response to the vertical translation of the handle and the pump rod along the pump longitudinal axis, the compression spring for urging the handle and the pump rod upwards for creating a negative pressure within the pump chamber and for drawing the fluid from the pump passageway into the pump chamber as the handle returns to the upper position.

17. The improved bottle jack of claim 16, wherein the compression spring is configured for directing the vertical translation of the compression spring along the pump longitudinal axis, the compression spring being constructed of zinc-plated high carbon steel, the preloaded state having a value of 30% for maintaining a uniform spring loaded pressure as the handle is vertically translated between the upper position and the lower position.

18. The improved bottle jack of claim 17, wherein the compression spring has a wire diameter measuring 0.150 inch, a free spring length measuring 3 inches, an outer spring diameter measuring 1.25 inches, a fill spring compressed length measuring 1.35 inches, and a preloaded spring length measuring 2.5 inches, the compression spring having a 75 pound force rating, the compression spring and a pump rod having a pump travel to spring compression ratio measuring 54%.

* * * * *